US007640699B2

(12) United States Patent
Gilleran

(10) Patent No.: US 7,640,699 B2
(45) **Date of Patent: *Jan. 5, 2010**

(54) AIR CONDITIONING LINE FLASHING PANEL

(76) Inventor: William J. Gilleran, 19 Cinnimon Teal, Aliso Viejo, CA (US) 92656

( * ) Notice: Subject to any disclaimer, the term of this patent is extended or adjusted under 35 U.S.C. 154(b) by 90 days.

This patent is subject to a terminal disclaimer.

(21) Appl. No.: 11/879,139

(22) Filed: Jul. 16, 2007

(65) Prior Publication Data

US 2007/0261327 A1 Nov. 15, 2007

Related U.S. Application Data

(63) Continuation of application No. 10/768,591, filed on Jan. 30, 2004, now Pat. No. 7,305,801.

(60) Provisional application No. 60/515,310, filed on Oct. 29, 2003.

(51) Int. Cl.
*H02G 3/18* (2006.01)
*H02G 3/08* (2006.01)

(52) U.S. Cl. ..... 52/220.1; 52/220.3; 52/220.88; 174/60; 174/61; 174/67; 174/480; 174/481; 220/3.2

(58) Field of Classification Search ..... 439/135, 439/468, 473, 131; 174/50–67, 480–481; 52/220.1, 220.2, 220.3, 220.5, 220.7, 220.8; 220/3.2

See application file for complete search history.

(56) References Cited

U.S. PATENT DOCUMENTS

| | | | | |
|---|---|---|---|---|
| 791,068 | A | | 5/1905 | Baker |
| 2,800,850 | A | | 6/1957 | McKann |
| 2,985,465 | A | | 5/1961 | Church |
| 3,371,503 | A | | 3/1968 | Perez |
| 3,438,219 | A | | 4/1969 | Brugler |
| 3,611,743 | A | * | 10/1971 | Manganaro ..... 62/263 |
| 3,651,245 | A | | 3/1972 | Moll |
| 3,683,305 | A | * | 8/1972 | Gray ..... 337/359 |
| 3,936,589 | A | | 2/1976 | Teeters et al. |
| 3,955,701 | A | | 5/1976 | Fisch |
| 4,102,090 | A | * | 7/1978 | Anguish ..... 52/58 |
| 4,135,337 | A | | 1/1979 | Medlin |
| 4,175,402 | A | | 11/1979 | Hile |
| 4,296,870 | A | | 10/1981 | Balkwill et al. |
| 4,473,244 | A | | 9/1984 | Hill |
| 4,526,407 | A | | 7/1985 | Kifer |
| 4,569,458 | A | | 2/1986 | Horsley |
| 4,607,469 | A | * | 8/1986 | Harrison ..... 52/220.8 |
| 4,673,097 | A | | 6/1987 | Schuldt |
| 4,757,158 | A | | 7/1988 | Lentz |
| 4,794,207 | A | | 12/1988 | Norberg et al. |

(Continued)

*Primary Examiner*—Jeanette Chapman
(74) *Attorney, Agent, or Firm*—Stetina Brunda Garred & Brucker

(57) ABSTRACT

There is provided a flashing panel mount adapted for an air conditioning unit which is located about an exterior of a building. The panel mount features a generally rigid panel that is attachable to the building. The panel mount further features a hood member which extends outward from the panel. A plurality of panel apertures is formed through the hood member and is configured to extend through the panel. Each of the panel apertures are sized and configured to accommodate a respective one of the air conditioning lines extending from within the building.

4 Claims, 5 Drawing Sheets

U.S. PATENT DOCUMENTS 4,874,189 A 10/1989 Gardner
4,903,997 A 2/1990 Kifer
4,924,032 A 5/1990 Akins
4,927,039 A 5/1990 McNab
4,952,752 A 8/1990 Roun
4,965,971 A 10/1990 Jean-Jacques et al.
5,012,043 A 4/1991 Seymour
5,064,386 A 11/1991 Dale et al.
5,171,939 A 12/1992 Shottey
5,199,784 A * 4/1993 Hempleman ..... 362/294
5,224,673 A 7/1993 Webb
5,246,255 A 9/1993 Forbes et al.
5,287,665 A 2/1994 Rath, Jr.
5,309,579 A 5/1994 Nelson
5,402,902 A 4/1995 Bouley
5,478,032 A 12/1995 Miller
5,526,619 A 6/1996 Vagedes
5,664,955 A * 9/1997 Arnett ..... 439/135
5,740,936 A 4/1998 Nash
5,803,508 A 9/1998 Lowella
D399,829 S * 10/1998 Reed ..... D13/156
5,886,295 A 3/1999 Carino et al.
5,918,431 A 7/1999 Schiedegger et al.
5,931,325 A 8/1999 Filipov
5,946,863 A 9/1999 Bullard
5,965,844 A 10/1999 Lippa
6,230,510 B1 5/2001 Price
6,239,365 B1 5/2001 McEvers
6,384,334 B1 5/2002 Webb
6,395,984 B1 5/2002 Gilleran
6,404,132 B1 6/2002 Krumholz
6,429,371 B2 8/2002 Schiedegger et al.
6,534,709 B2 3/2003 English
6,608,253 B1 8/2003 Rintz
6,649,835 B2 11/2003 Gilleran
6,668,852 B1 12/2003 Williamson
6,774,307 B2 8/2004 Kruse et al.

* cited by examiner

AIR CONDITIONING LINE FLASHING PANEL

CROSS-REFERENCE TO RELATED APPLICATIONS

The present application is a continuation of U.S. patent application Ser. No. 10/768,591 entitled AIR CONDITIONING LINE FLASHING PANEL filed Jan. 30, 2004, now U.S. Pat. No. 7,305,801 which claims the benefit of U.S. Provisional Application No. 60/515,310, filed Oct. 29, 2003, the entirety of the disclosures of which are expressly incorporated herein by reference.

STATEMENT RE: FEDERALLY SPONSORED RESEARCH/DEVELOPMENT (Not Applicable)

BACKGROUND OF THE INVENTION

The present invention relates generally to exterior wall mount flashing for extending air conditioning lines through a wall of a building, and more particularly to an air conditioning flashing panel mount which provides a plurality of apertures adapted to receive a refrigerant and/or electrical control line of an air conditioning system through a wall of a residential and/or commercial building so as to eliminate any access into the building by unwanted intrusions such as air, water, rodents and/or the like.

As is commonly known, air conditioners typically use the evaporation of a refrigerant, like Freon, to provide air cooling. For example, conventional window mounted air conditioners have traditionally been utilized in small indoor spaces (e.g., one-bedroom apartment). This type of air conditioner is made small enough to fit into a standard window frame. The air conditioner is then operated for cooling in which its fan blows air over its condenser coils to deliver cold air to the indoor space.

Although conventional window air conditioners are suitable for small indoor spaces, they are not, however, effective or efficient for cooling larger indoor spaces such as a residential house or a commercial building. As such, central air conditioners are typically used for larger residential houses and commercial buildings. The central air conditioner is a more efficient way to cool such larger indoor spaces by providing controlled flow of chilled air through the air ducts of a conventional forced-air heating/cooling system.

As is known, central air conditioners include a compressor typically installed outside the residential house or commercial building and a condenser typically located inside the building and resident within a conventional forced air heating and ventilation system.

Typically, the compressor of the central air conditioner is placed on a concrete pad located outside the residential house or commercial building. It is connected to the condenser disposed within forced-air heating system located inside the house or by a number of air conditioning lines/conduits which extend through a section of an exterior wall of the building. More specifically, two refrigerant lines (typically copper lines for supplying/delivering a compressed refrigerant gas) and a control line (electrical line for selectively activating the compressor and fan of the air conditioning system) extend between the outside-located compressor and the inside-located condenser of the forced-air heating system.

As specifically illustrated in FIG. 1, an exterior roof jack flashing 10 is typically utilized in the prior art for extending the refrigerant lines 12 and the control line 14 through a particular exterior wall section 16 of a residential house or commercial building 18. Essentially, the roof jack flashing 10 conventionally used by the construction and home-improvement industries features a conically shaped sheet metal body 20 which protrudes outwardly through the outer surface 22 of the wall section 16 and provides a single enlarged opening 24 leading to the inside of the house or building 18. By providing such access through the wall section 16, the two refrigerant lines 12 and the control line 14 may be run through the single enlarged opening 24 for extension between the air conditioner compressor and condenser.

However, due to its extensive size, the opening 24 of the roof jack flashing 10 remains substantially open, i.e., unfilled, despite the number of air conditioning lines 12, 14 passing therethrough. This makes the inside of the house or building 18 very vulnerable to undesirable elements such as air, moisture or rodents entering from outside. As will be recognized, this poses a significant problem since the air, moisture, rodents and the like may damage the structural integrity and/or the aesthetic appearance of the house or building 18, not to mention providing a substantial health risk to occupants.

In an attempt to alleviate this problem, it has been a common practice in the field to simply push a rag or fabric matting 26 around the lines to block the opening 24. More particularly, the rags or fabric matting 26 are typically dipped in a sealant such as tar and pushed into the opening 24 to fill the spacing surrounding the air conditioning lines 12, 14. As an alternative method, foam adhesive tapes were also used to seal off the opening 24.

Although such method has proved to be somewhat effective initially in sealing the opening 24, it is significantly deficient to seal the opening over time. More specifically, due to it's fabric structure, the rag or matting 26 tends to degrade over time. This is also the same for the foam adhesive tapes which tend to degrade over time. Further, the pliability or flexibility of the rag or matting 26 allows shifting from its original sealing positions when the exterior wall vent 10 is inadvertently contacted.

As such, the initial seal of the opening 24 can be eventually breached over time which may expose the inside of the house or building 18 to unwanted outside elements such as air, rodents and moisture. The breach in the opening's seal may not be discovered until the results of the exposure have already occurred. This usually leads to problems such as internal water damage or rodent infestation. Moreover, any attempt to remedy the breach may cause unintentional damage to the exterior finish (e.g., stucco, wood siding or paint) of the residential house or commercial building 18.

In view of the above-described shortcomings of conventional exterior roof jack flashing, there exists a need in the art for an exterior wall mount flashing that can optimally seal off any opening or access to the inside of a house or a building while extending each of the air conditioning lines therethrough. More specifically, there exists a need for an exterior wall mount which can maintain such seal continuously over time so as to prevent any unwanted intrusions by air, water, rodents and/or the like into the house or building.

BRIEF SUMMARY OF THE INVENTION

The present invention specifically addresses and alleviates the above-referenced deficiencies associated with the use of the exterior roof jack flashing of the prior art. More particularly, the present invention comprises an improved air conditioning flashing panel mount which provides a plurality of panel apertures adapted to preferably accommodate a separate line of an air conditioning system through a wall of a residential and/or commercial building. By providing multiple panel apertures that can closely fit and seal their respective air conditioning lines extending therethrough, the flashing panel mount of the present invention eliminates the need for a single enlarged opening characterized in conventional prior art exterior wall mounts. This effectively prevents any unwanted intrusions from the outside environment such as air, water, rodents and/or the like from coming into the inside of the residential and/or commercial building.

In accordance with a first preferred embodiment of the present invention, there is provided an air conditioning flashing panel mount adapted to provide a generally water proof physical seal of the air conditioning lines extending into the residential and/or commercial building. The flashing panel mount of the first preferred embodiment first features a substantially flat and generally rigid or semi-rigid panel. This panel is sized and configured to be attached to a wall of the building adjacent to an exteriorly located air conditioning unit or compressor. A second surface of the panel is abutted directly against the frame of the exterior wall (e.g., wood or metal studs) in which conventional fasteners such as nails are driven through the first surface thereof for attachment to the wall frame.

In the first preferred embodiment of the present invention, the flashing panel mount of the present invention also features a hood member. This hood member extends outwardly from the first surface of the panel, and more preferably extends out from about the central portion of the panel. The hood member is preferably made from the same material which is used to fabricate the panel. A recess is formed within the hood member which is sized and configured to be accessed only through a second surface of the panel. More specifically, an opening is provided at the second panel surface for exposing the panel recess through that surface.

Formed through the lower surface of the hood member are a plurality of panel apertures, each preferably adapted to accommodate a respective one of the air conditioning lines therethrough. Each of the panel apertures provide a pathway in which the air conditioning lines can be extended through the flashing panel mount. The panel apertures are preferably sized to closely fit the diameter size of their respective air conditioning lines.

In the first preferred embodiment of the present invention, a sealing member may additionally be provided on each aperture. Each sealing member preferably comprises an elastomeric sheet or rubber grommet which is positioned around an circumferential edge that forms the respective panel aperture.

There is further provided an air conditioning flashing panel mount which is constructed in accordance with a second preferred embodiment of the present invention. The flashing panel mount of the second preferred embodiment is designed to perform the identical function as that of the first embodied panel mount. However, its structure and the manner of use are slightly modified.

In particular, the flashing panel mount of the second preferred embodiment is attached to the wall of the building in a reverse orientation. More particularly, the first surface of its panel is abutted directly against the frame of the wall so that fasteners such as nails, can be driven through the second panel surface for attachment to the wall frame. By such reverse attachment, its hood member is no longer extending outwardly from the building but rather is disposed within the interior portion of the wall frame.

Unlike the first embodiment, the panel apertures are formed through the upper hood surface rather than through the lower hood surface. Further unlike the first embodiment, a flanged frame is provided around the recess opening in order to prevent any water or moisture from entering the panel recess. The flanged frame surrounds the recess opening, and is preferably placed immediately around the opening's edge.

With the structure defined, the operation of the air conditioning flashing panel mount of the first embodiment is described herein to essentially illustrate the operation of the flashing panel mount of the second embodiment as well. Initially, a user (e.g., construction worker) fastens (via nails, for example) the panel mount onto the selected section of the building's exterior wall. Of course, in the case of the flashing panel mount of the second embodiment, the orientation of its attachment would be reversed.

The two refrigerant lines and the single electrical control line are brought through the wall and into the panel recess through its recess opening. Thereafter, the air conditioning lines are inserted through the respective panel apertures formed at the lower hood surface so as to be extended fully through the flashing panel mount of the first embodiment. They are then connected to the air conditioning unit or compressor located outside the building and connected therewith. In the flashing panel mount of the second embodiment, the air conditioning lines are first inserted through the panel apertures formed at the upper hood surface and then extended out of the panel recess through its recess opening. Any exposed portions of the refrigerant lines may be optionally wrapped or surrounded by an insulation padding.

Once the air conditioning flashing panel mount becomes mounted and installed, a first layer of lath paper is then brought from below and positioned underneath the panel up to the bottom edging forming the recess opening. In addition, a second layer of lath paper is brought from above and placed over the panel to cover its surface with the exception of the outwardly extending hood member. Upon such application of lath papers, lath and stucco or conventional siding is used over the second layer of lath paper in order to finish the installation of the exterior wall. By incorporating such flashing panel mount into the structure of the building, any access created by the air conditioning lines can now be effectively eliminated so as to deter the problems associated therewith.

BRIEF DESCRIPTION OF THE DRAWINGS

These as well as other features of the present invention will become more apparent upon reference to the drawings wherein.

DETAILED DESCRIPTION OF THE INVENTION

Figure 1:
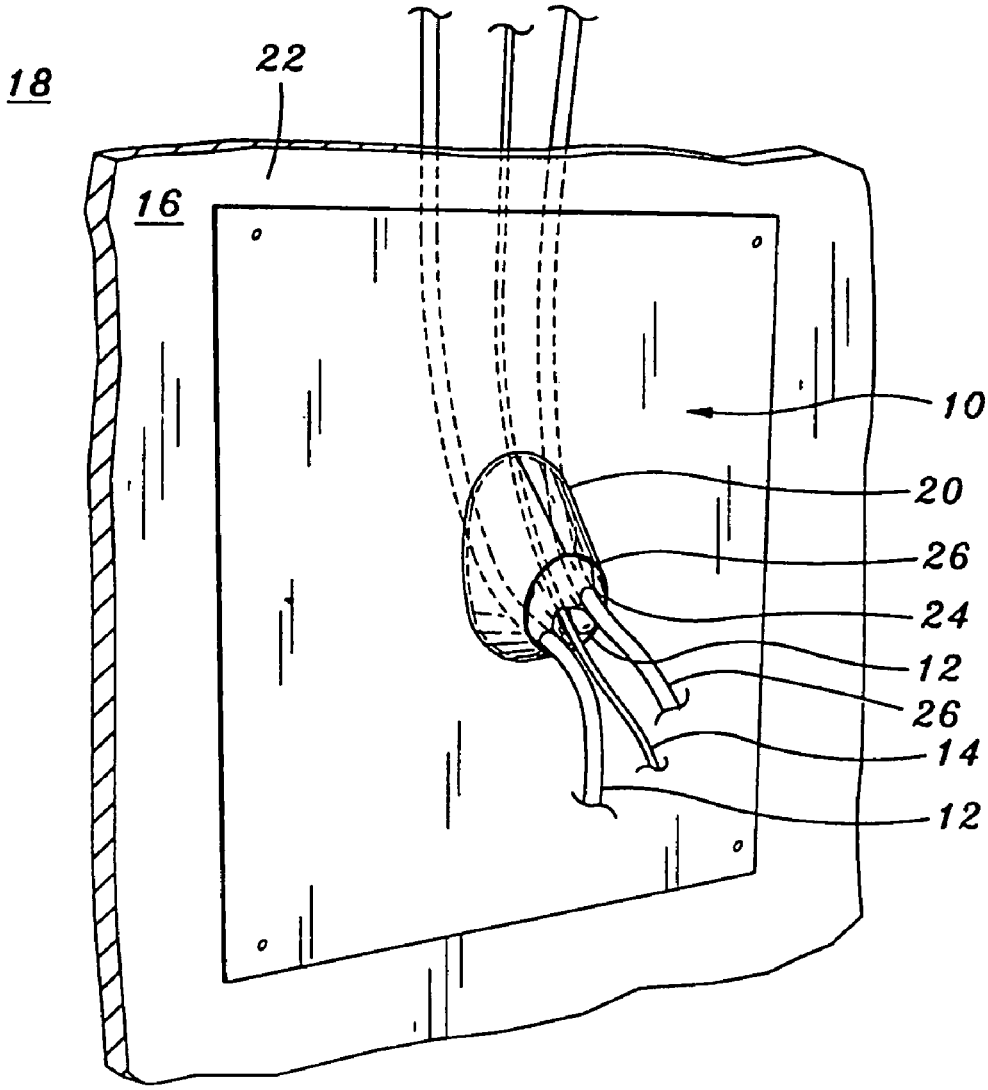
Fig. 1 (PRIOR ART)
FIG. 1 is a perspective view of a prior art exterior roof jack flashing conventionally used for extending the air conditioning lines through a wall of a residential and/or commercial building.
Figure 2:
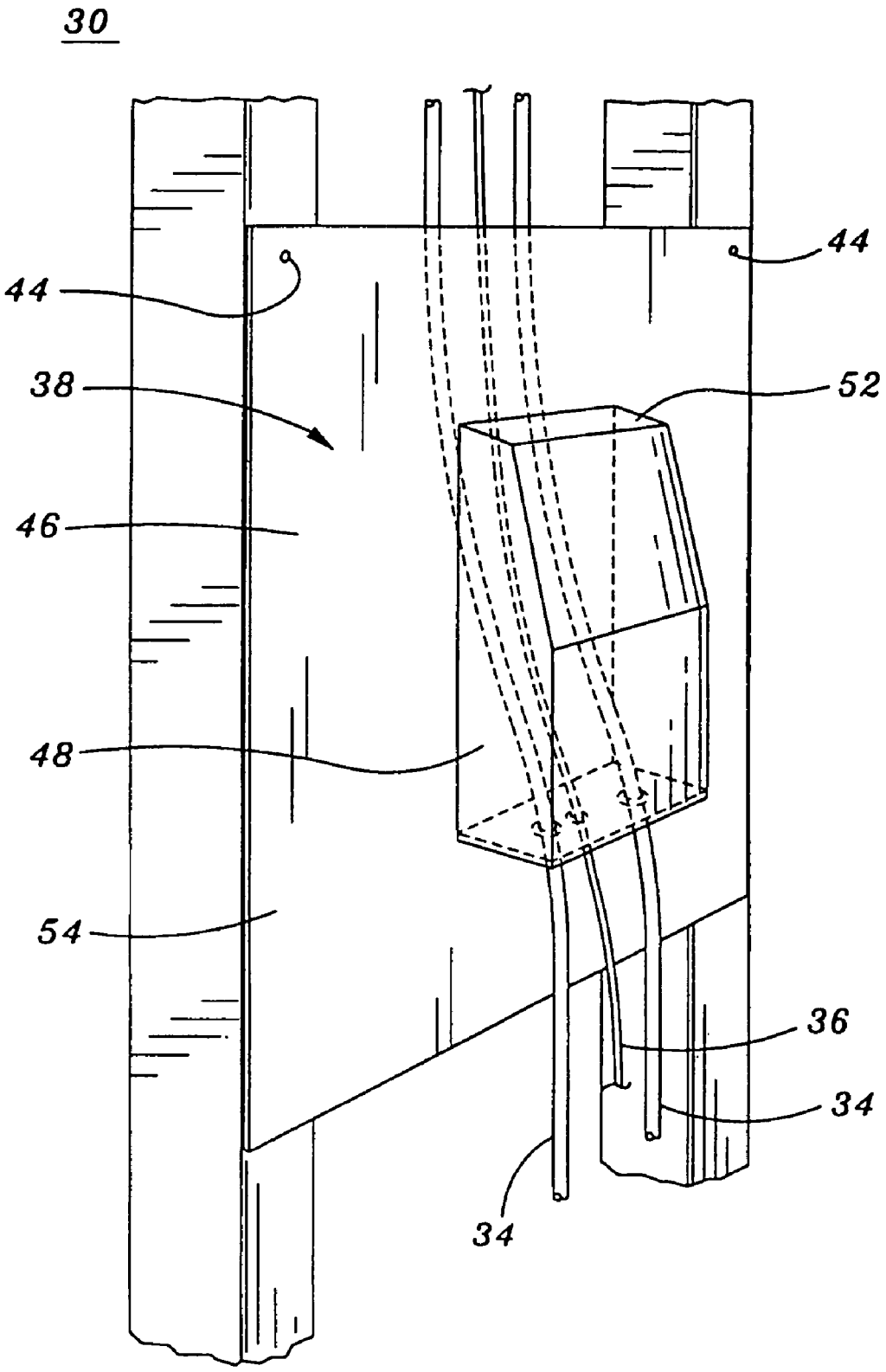
FIG. 2 is a perspective view of an air conditioning flashing panel mount constructed in accordance with a first preferred embodiment of the present invention and illustrating a hood member which extends outward from its first surface.

Referring now to the drawings wherein the showings are for purposes of illustrating preferred embodiments of the present invention only, and not for purposes of limiting the same, FIG. 2 perspectively illustrates an air conditioning flashing panel mount 30 constructed in accordance with a first preferred embodiment of the present invention. As indicated above, the present flashing panel mount 30 provides a plurality of panel apertures 32 each adapted to accommodate a separate line of an air conditioning system through a wall 16 of a residential and/or commercial building 18. By providing multiple panel apertures 32 that can closely fit and seal their respective air conditioning lines 34, 36 extending therethrough, the present flashing panel mount 30 eliminates the prior art feature of a single enlarged opening that characterizes the conventional exterior wall mounts 10. As will be soon discussed, this effectively prevents any unwanted intrusions from the outside environment such as water, rodents and/or the like from coming into the inside of the residential and/or commercial building 18.

Before proceeding with the substantive explanations of the present invention, it is important to clarify certain terminologies used herein for the purpose of better understanding the present invention. First, the term "residential building" used throughout this section should not be construed narrowly, but rather broadly to mean any type of facility which is intended for residential purposes. Examples of such facilities include, but are not limited to, residential houses, apartments, condominiums, cabins, trailer homes and the like. Furthermore, the term "commercial building" should also be interpreted broadly to include any facility that is intended for purposes other than for residence such as hotels, motels, retail stores, office buildings, factory buildings and the like.

Figure 3:
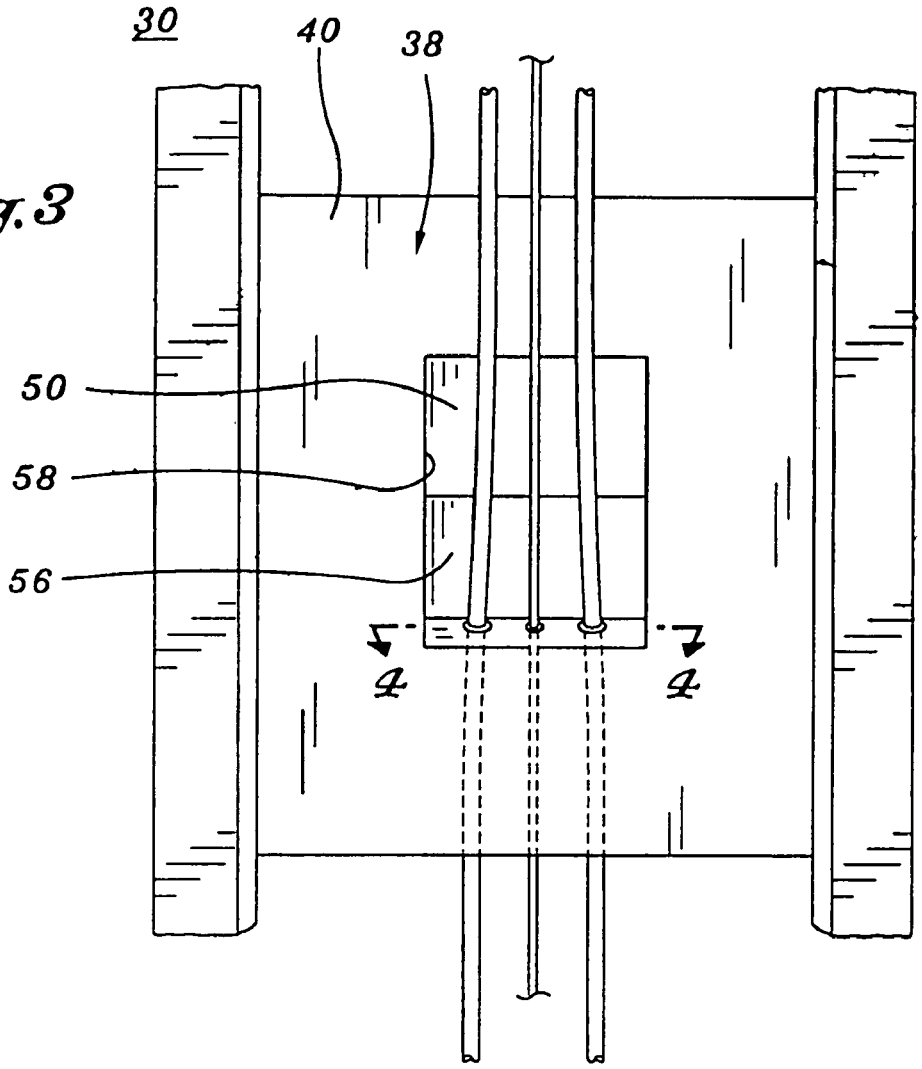
FIG. 3 is a rear view of the flashing panel mount shown in FIG. 2 and illustrating a plurality of air conditioning lines extending through a respective one of the panel apertures formed at the lower surface of the hood member.
Figure 4:
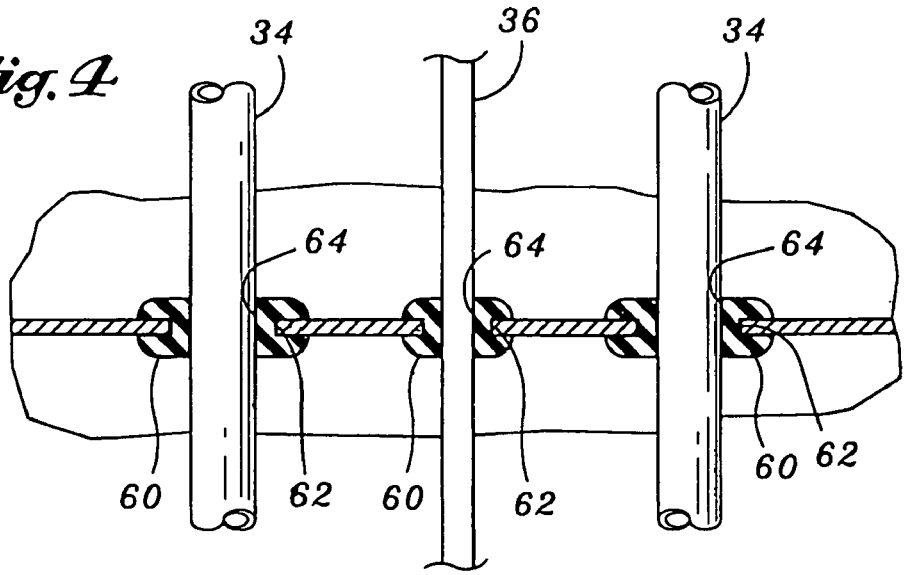
FIG. 4 is a cross-sectional view of the panel apertures shown in FIG. 3 and illustrating a plurality of sealing members each positioned around their respective panel apertures.

Referring more particularly to FIGS. 2-4, the air conditioning flashing panel mount 30 of the first preferred embodiment includes a panel 38 adapted to be attached to the wall 16 of the building 18 which is adjacent to an exteriorly located air conditioning unit or compressor (not shown). More specifically, a second surface 40 of the panel is abutted directly against frames 42 of the wall 16 (e.g., wood studs) in which fasteners 44 such as nails, screws or staples are driven through the first surface 46 thereof for attachment to the wall frames 42. As such, the first panel surface 46 is faced away from the building 18 when the panel 38 is attached thereto. Of course, the second panel surface 40 would face toward the building 18.

This panel 38 may be fabricated from any material which can provide semi-rigidity or rigidity after fabrication such as sheet metal or plastic. However, plastic is the material of choice as it can be easily molded to form a one-piece panel. Although the panel 38 may possess various configurations and sizes, it is preferably flat and rectangular in configuration, and has a size which is sufficient to create an enlarged moisture-impervious perimeter around the air conditioning lines 34, 36.

The flashing panel mount 30 of the first preferred embodiment also features a hood member 48 which extends outward from the first surface 46 of the panel 38. Although such hood member 48 may be outwardly extended from any location of the first panel surface 46, it is preferred that the hood member 48 extends out from about the central portion 50 of the panel 38 so that the water-impervious perimeter formed by the panel 38 is evenly set around the hood member 48. Preferably, the hood member 48 is made from the same material which is used to fabricate the panel 38. The hood member 48 of the first preferred embodiment may be formed to have various configurations and shapes. Preferably, however, it is generally rectangular in configuration so as to define substantially planar upper and lower hood surfaces 52, 54, the significance of which will be described later.

The interior of the hood member 48 is substantially hollow and void. Hence, a recess 56 is formed within the hood member 48 which can be accessed only through a second surface 40 of the panel 38. More specifically, an opening 58 is provided at the second panel surface 40 for exposing the panel recess 56 through that surface 40. Even though the recess opening 58 may be sized to only partially expose the panel recess 56, it is preferred that the size of the opening 58 is substantially equivalent to that of the panel recess 56 so as to fully expose the panel recess 56 therethrough.

Formed through the lower surface 54 of the hood member 48 are a plurality of panel apertures 32 each specifically adapted to accommodate a respective one of the air conditioning lines 34, 36 therethrough. Each of the panel apertures 32 communicate with the panel recess 56 which is exposed through the recess opening 58. This provides a series of pathways in which the air conditioning lines 34, 36 can be extended through the flashing panel mount 30 of the first preferred embodiment.

Although not by way of limitation, the number of panel apertures 32 provided is preferably identical to the number of the air conditioning lines 34, 36 that need to extend through the wall 16 of the building 18. In this respect, there are three panel apertures 32 to accommodate the two refrigerant lines 34 and the electrical control line 36 that are elongated between the exteriorly-located air conditioning unit or compressor and the interiorly-located forced-air heating system (not shown).

The panel apertures 32 are preferably sized to closely fit the diameter size of their respective air conditioning lines 34, 36. Thus, the panel apertures 32 intended for the refrigerant lines 34 would be larger in size than the panel aperture 32 intended for the electrical control line 36. By conforming the aperture sizes to the line sizes, it significantly reduces any spacing between the panel apertures 32 and their respective air conditioning lines 34, 36. This lessens the amount of access into the residential and/or commercial building 18.

Referring now to FIGS. 3 and 4, a sealing member 60 may be provided to seal off each aperture 32 while allowing the respective air conditioning line 34 or 36 to pass through. Each sealing member 60 is preferably a grommet which is positioned around an aperture edging 62 that forms the respective panel aperture 32. The sealing member 60 or grommet may be described as having an O-ring configuration. More specifically, each of the grommets has a groove 64 which captures the edge 62 of their respective panel apertures 32 so as to be fixed in position. Preferably, the grommets are each fabricated from an elastomeric material such as rubber so as to protect the structural integrity of both the aperture edgings 62 and the lines 34, 36 passing therethrough.

Alternatively, it should be noted that the lower surface 54 of the hood member 48 may be formed of a stretchable sheet or membrane. Such sheet or membrane may be fabricated from various types of stretchable material. One type of such material is an elastomeric material such as rubber. In this regard, slits or holes may be created directly through the lower surface 54 which may simulate the panel apertures 32 upon stretching the sheet or membrane. This may be accomplished simply by cutting through the lower surface 54 with a cutting tool, or any of the like procedures. This would eliminate the need for using sealing members 60 such as grommets around the panel apertures 32.

Figure 6:
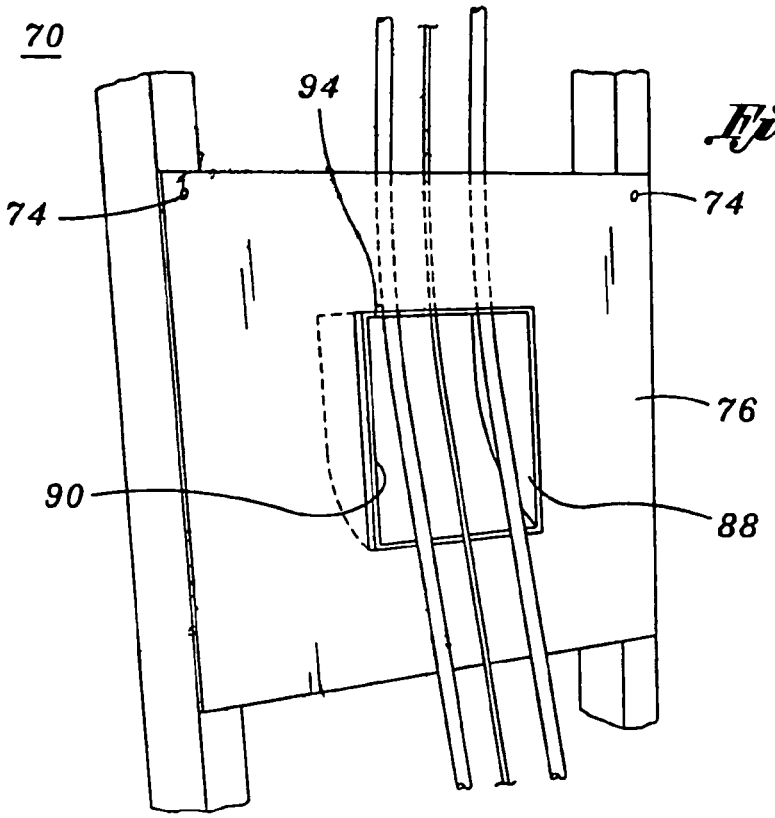
FIG. 6 is a perspective view of an air conditioning flashing panel mount constructed in accordance with a second preferred embodiment of the present invention and illustrating a panel recess which is exposed through its second surface via a recess opening.
Figure 7:
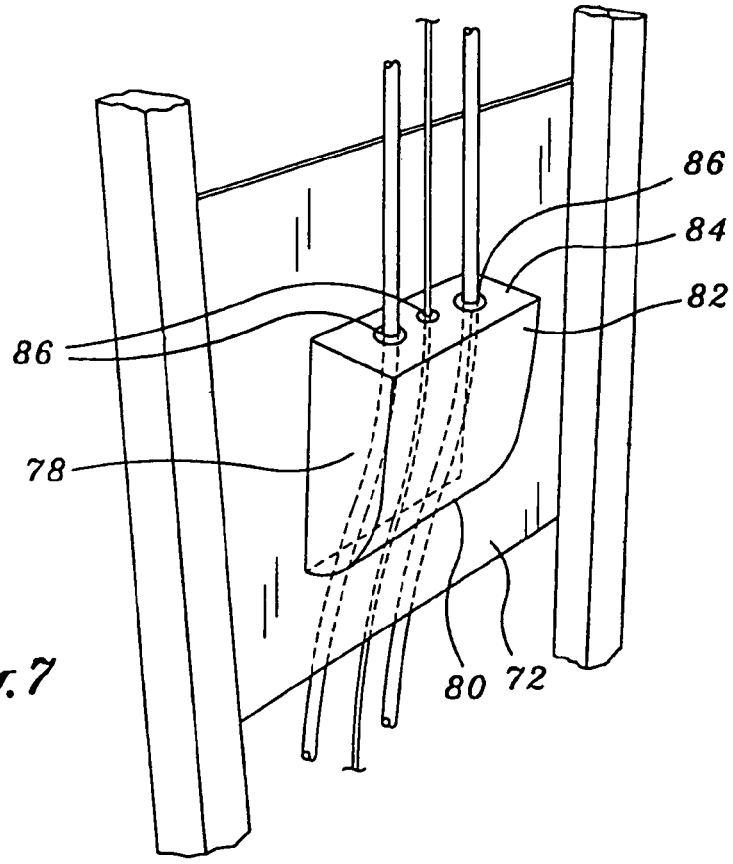
FIG. 7 is a rear view of the flashing panel mount shown in FIG. 6 and illustrating a hood member extending outward from its first surface and including a plurality of panel apertures formed at the upper surface thereof.

Referring now to FIGS. 6 and 7, there is further provided an air conditioning flashing panel mount 70 which is constructed in accordance with a second preferred embodiment of the present invention. The flashing panel mount 70 of the second preferred embodiment is designed to perform the identical function as that of the version reflected in the first embodiment. However, its structure and the manner of use are slightly modified in comparison to the first version.

In particular, the flashing panel mount 70 of the second preferred embodiment is attached to the wall 16 of the residential and/or commercial building 18 in a reverse orientation. More particularly, the first surface 72 of its panel is abutted directly against the frames 42 of the wall 16 so that fasteners 74 such as nails can be driven through the second panel surface 76 for attachment to the wall frames 42. Consequently, the first panel surface 72 becomes faced toward the building 18 while the second panel surface 76 is faced away therefrom.

By such reverse attachment, its hood member 78 is no longer extending outward from the building 18 but rather extends inwardly within the wall. Although the hood member 78 of the second preferred embodiment may be shaped similar or identical to the first embodied hood member 48, the second hood member 78 is different in that its shaping is more of a half arcuate configuration rather than a general rectangular configuration. The hood member 78 tapers gradually outward from the first panel surface 72 from its lower portion 80 to its upper portion 82, thereby producing a planar surface 84 at the upper hood portion 82.

Unlike the first embodiment, the panel apertures 86 are formed through the upper hood surface 84, and not through the lower hood surface. However, similar to the first versioned panel apertures 32, the panel apertures 86 of the second embodiment are also placed in fluid communication with the panel recess 88 and share the size and shape which are consistent therewith. Further, the use of sealing members 60 for sealing the panel apertures 86 also applies here. In this respect, each of the air conditioning lines 34, 36 may be first extended from the inside of the building 18 through the respective panel apertures 86 so as to be led out of the panel recess 88 through its recess opening 90 for connection to the outside located air conditioning unit or compressor.

In order to prevent any water or moisture from entering into the outwardly faced panel recess 88, a flanged frame 92 is provided around the recess opening 90. More specifically, the flanged frame 92 is formed to be complimentary in shape to the edging 94 forming the recess opening 90. Hence, the flanged frame 92 surrounds the recess opening 90, and is preferably placed immediately around the opening's edging 94. The flanged frame 92 utilized in the second embodiment is preferably fabricated from the same material which was used for the manufacture of the panel mount 70. As such, the flanged frame 92 deters any water or moisture which runs down the outer surface 22 of the wall 16 of the building 18 from entering into the panel recess 88 through its recess opening 90.

Figure 5:
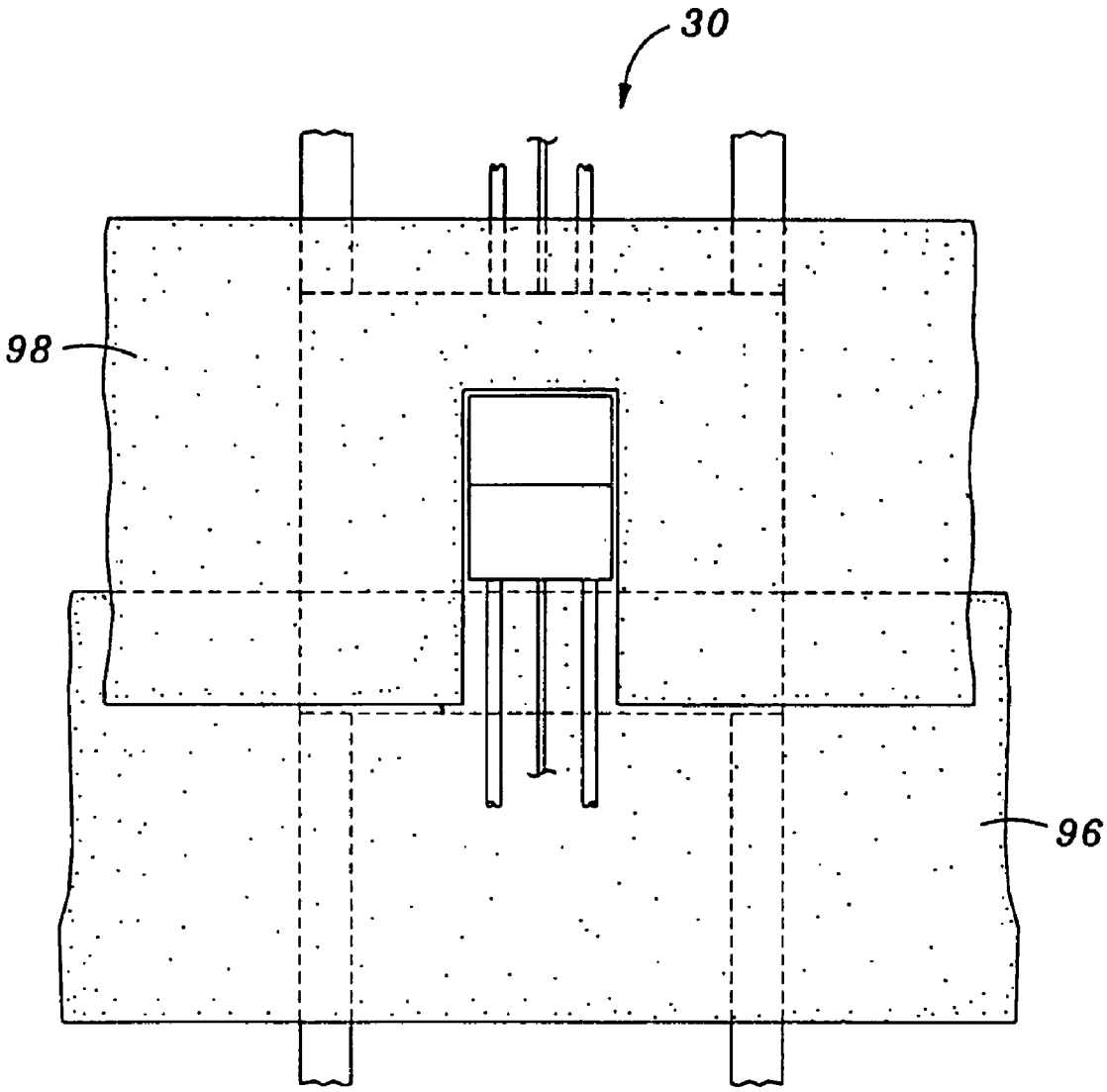
FIG. 5 is an elevation cut-away view of a wall portion of a building shown in FIG. 1 and illustrating the installation of the flashing panel mount of FIG. 2 with respect thereto.

Referring now to FIG. 5, the operation of the air conditioning flashing panel mount 30 of the first embodiment is described herein to essentially illustrate the operation of the flashing panel mount 70 of the second embodiment as well. The flashing panel mount 30 of the first embodiment is designed for the purpose of protecting the inside of a residential and/or commercial building 18 from any unwanted intrusions from outside such as rodents or water by sealing each of the air conditioning lines 34, 36 extending therethrough. Initially, a user (e.g., construction worker, etc.) fastens (via nails, for example) the panel mount 30 onto the selected exterior section of the building's wall 16 in a manner that its hood member 48 is faced outside and the panel recess 56 is faced inside. Of course, in the case of the flashing panel mount 70 of the second embodiment, the manner of its attachment would be reversed, as described above.

The two refrigerant lines 34 and the single electrical control line 36 are brought into the panel recess 56 through its recess opening 58. Thereafter, the air conditioning lines 34, 36 are inserted through the respective panel apertures 32 formed at the lower hood surface 54 so as to be extended fully through the flashing panel mount 30 of the first embodiment. They are then led to the air conditioning unit or compressor located outside the residential and/or commercial building 18 and connected therewith. As mentioned above in the description of the second embodied flashing panel mount 70, the air conditioning lines 34, 36 are first inserted through the panel apertures 86 formed at the upper hood surface 84 and then led out of the panel recess 88 through its recess opening 90. Any exposed portions of the refrigerant lines 34 may be optionally wrapped or surrounded by a thermal padding (now shown), preferably a foam padding.

Once the air conditioning flashing panel mount 30 becomes mounted and installed, a first layer of lath paper 96 is then brought from below and positioned underneath the panel 38 up to the bottom edge forming the recess opening 58. In addition, a second layer of lath paper 98 is brought from above the panel 38 to cover its surface 46 with the exception of the outwardly extending hood member 48. Upon such application of lath papers 96, 98, lath and stucco or conventional siding is used over the second layer of lath paper 98 in order to finish the installation of the exterior wall 16. By incorporating such flashing panel mount 30 into the structure of the building 18, any access created by the air conditioning lines 34, 36 can now be effectively eliminated so as to deter the problems associated therewith.

Additional modifications and improvements of the present invention may also be apparent to those of ordinary skill in the art. Specifically, those of ordinary skill will recognize that the electrical control line may additionally be brought through one of the refrigerant line apertures thereby eliminating the need for a preferred separate electrical control line aperture formed in the panel mount. Thus, the particular combination of parts described and illustrated herein is intended to represent only certain embodiments of the present invention, and is not intended to serve as limitations of alternative devices within the spirit and scope of the invention.

What is claimed is:

1. An air conditioning system for a building, the system comprising:

an air conditioning unit located about an exterior of the building;

a continuous refrigerant line defining a first end and a second end, the first end of the continuous refrigerant line disposed about the air conditioning unit located about the exterior of the building, the continuous refrigerant line disposed through a hole in a wall of the building, the hole being formed above grade, the second end of the continuous refrigerant line disposed within the building;

a flashing panel mount for routing the continuous refrigerant line from the air conditioning unit through the hole in the wall of the building to within the building for preventing entrance of undesirable material into the building through the hole of the building, the mount comprising:

a flashing panel attachable to the exterior of the building;

a hood member extending outward from the panel, the hood member having a lower hood surface;

a panel aperture formed though the lower hood surface of the hood member and defined by an aperture edge of the lower hood surface of the hood member; and an elastic sealing member attached to the aperture edge of the lower hood surface of the hood member, the elastic sealing member having a generally o-ring configuration for accommodating the continuous refrigerant line and for generally forming a seal to prevent entrance of undesirable material into the building through the hole of the wall of the building.

2. The system of claim 1 wherein the sealing member is a grommet.

3. The system of claim 2 wherein the grommet has a groove which captures the aperture edge.

4. The system of claim 1 wherein the flashing panel is attached to the exterior of the building.

* * * * *